US005176512A

United States Patent [19]

Evens

[11] Patent Number: 5,176,512

[45] Date of Patent: Jan. 5, 1993

[54] INSHOT BURNER CLUSTER APPARATUS

[75] Inventor: Lance J. Evens, Carrollton, Tex.

[73] Assignee: Lennox Industries Inc., Dallas, Tex.

[21] Appl. No.: 668,954

[22] Filed: Mar. 13, 1991

[51] Int. Cl.[5] ..... F23D 14/62

[52] U.S. Cl. ..... 431/354; 431/286; 126/99 R

[58] Field of Search ..... 431/354, 286, 353; 126/104 R, 116 R, 99 A, 99 R; 239/597, 598, 600

[56] References Cited

U.S. PATENT DOCUMENTS 3,938,945 2/1976 Riehl ..... 431/191
4,729,207 3/1988 Dempsey et al. ..... 431/12 X
4,938,283 7/1990 Wood et al. .
4,962,749 10/1990 Dempsey et al. ..... 431/2
5,035,609 7/1991 Riehl ..... 431/354 X

*Primary Examiner*—Larry Jones
*Attorney, Agent, or Firm*—Allegretti & Witcoff, Ltd.

[57] ABSTRACT

The improved inshot burner cluster apparatus of the present invention functions to provide combustion of a gaseous fuel and air mixture which is injected through an aperture in the inlet plate into the combustion compartment of a heat exchanger, and includes a burner cluster which may have a selected multiplicity of burners formed from an interjoined upper half shell and a lower half shell. The modular, and essentially clamshell, form of construction allows for ease of forming the burner elements by embossing the sheet metal half shells, for example using a progressive type of punch press die which can thereafter cut-off any number of burners to form a burner cluster.

18 Claims, 1 Drawing Sheet

INSHOT BURNER CLUSTER APPARATUS

BACKGROUND OF THE INVENTION

The present invention relates to the field of induced draft combustion furnaces employing heat exchangers, and more particularly to an improved inshot burner cluster apparatus of simplified, stable, economical, and durable construction.

In the prior art, various forms of burners have been utilized in conjunction with induced draft combustion furnaces of the type employing heat exchangers. In particular, inshot burners have been utilized for injecting a fuel and air mixture for combustion into the combustion chamber of a heat exchanger assembly for combustion therein, and to radiate heat energy therefrom into the forced air stream of the furnace for circulation to the area to be heated. One such inshot burner is generally utilized for each sectional gas fired heat exchanger. Accordingly, multiple individual heat exchanger units have been required for utilization with respective multiple gas fired heat exchangers. One example of the individual inshot burner devices as utilized in the prior art is set forth in U.S. Pat. No. 4,938,283.

In the prior art, a multiplicity of individual inshot burners have required separate formation, have necessitated the use of many different shapes and sizes of component parts, have required complex machinery for the formulation thereof, and have required labor intensive assembly—all of which has unnecessarily complicated the fabrication and assembly procedures and has thus resulted in an increase in capital expense for production of such inshot burners. Yet additionally, the prior art utilization of individual inshot burners has necessitated in some instances additional maintenance which has been of greater than necessary complexity.

In view of the above difficulties, detriments and deficiencies of prior art individually formed inshot burners, it is a principal object of the present invention to provide an improved inshot burner cluster apparatus for use in association with an induced draft combustion heat exchanger.

It is a further object of the improved inshot burner cluster apparatus of the present invention to provide such apparatus for use to decrease the complexity of fabrication thereof, whereby initial cost and maintenance expenses may be reduced. Other objects and advantages will become more apparent hereinafter.

SUMMARY OF THE INVENTION

In accordance with the various aspects of preferred embodiments of the present invention, the improved inshot burner cluster apparatus of the present invention includes a burner cluster which may have a selected multiplicity of burners formed from an upper half shell and a lower half shell, which may be joined either mechanically, such as for example by tabs, or by welding. The modular, and essentially clam-shell form of construction of the present invention, allows for ease of formation of the burner elements by embossing the sheet metal half shells, for example by using a progressive type of punch press die, which can thereafter be cut off in any number of burners to form a burner cluster.

The improved inshot burner cluster apparatus of the present invention functions to provide combustion of a gaseous fuel and air mixture which is injected through an aperture in the inlet plate and into the combustion chamber of a heat exchanger.

The above representational objects, features and advantages of the improved inshot burner cluster apparatus of the present invention will become more completely understood by those skilled in art upon a review of the following brief description of the drawing, detailed description of preferred embodiments, appended claims and accompanying Drawing.

BRIEF DESCRIPTION OF THE DRAWING

The improved inshot burner cluster apparatus of the present invention is set forth in the following Figures, wherein common numerals are utilized to represent common elements, and in which.

DETAILED DESCRIPTION OF PREFERRED EMBODIMENTS

Figures 1, 2, 3, 4, 5:
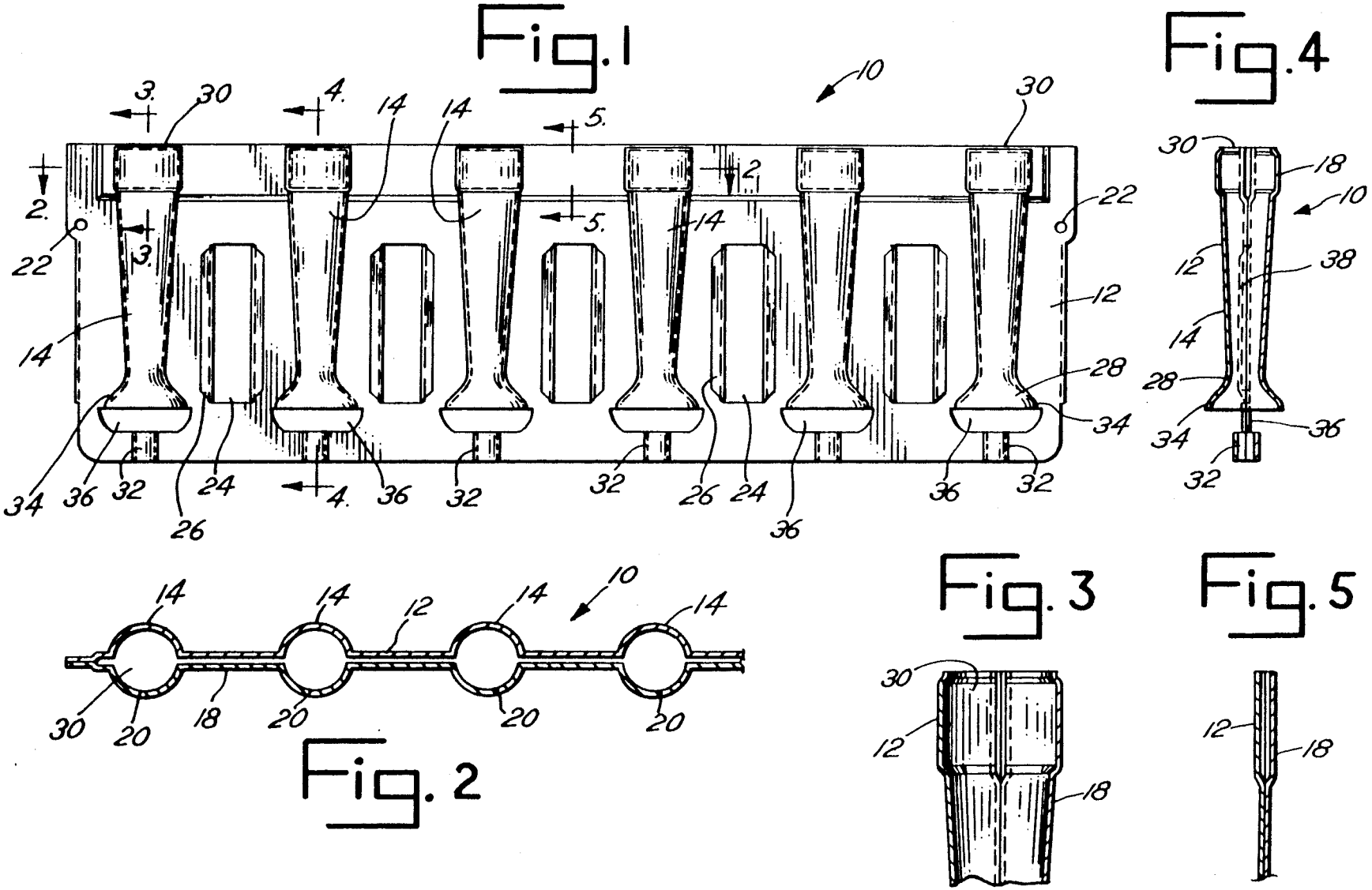
FIG. 1 is a top plan view of the improved inshot burner cluster apparatus of the present invention showing an upper burner half shell formed from a sheet of embossed metallic sheet, and showing thereon a plurality of the upper longitudinal halves of a multiplicity of spaced inshot burners, and showing disposed therebetween securement openings for the folding over of flanges from the lower burner half shell disposed therebeneath.
FIG. 2 is a front-on view of the inshot burner cluster apparatus taken lines 2—2 of FIG. 1, and showing the gaseous fuel and air discharge opening, and further showing the flame propagation trough disposed between the individually embossed inshot burner halves.
FIG. 3 is an enlarged transverse cross-sectional view taken along line 3—3 of FIG. 1, and showing the particular shape of one embodiment of the improved inshot burner cluster hereof.
FIG. 4 is a transverse cross-sectional view taken along line 4—4 of FIG. 1, and showing a transverse cross-sectional view taken entirely through the improved inshot burner cluster apparatus of the present invention, and showing one preferred shape for the body thereof and further including the primary air hole as disposed between the gas orifice opening and the bell-shaped inshot burner gas and air entry port.
FIG. 5 is an enlarged cross-sectional view taken along line 5—5 of FIG. 1, and showing a cross-sectional view of the flame propagation slit formed between the upper and the lower burner half shells of the improved inshot burner cluster apparatus of the present invention.

The improved inshot burner cluster apparatus of the present invention includes an upper burner half shell which is formed from a sheet of embossable metallic material. The upper burner half shell includes a plurality of longitudinal upper burner halves for each of the corresponding inshot burners, which are embossed into the metallic sheet material in spaced, and preferably evenly spaced, array. The upper burner half shell is accompanied by a matching and an essentially identically shaped lower burner half shell, which is likewise formed from a sheet of the embossable metallic material. As with the upper burner half shell, the lower burner half shell defines thereby a plurality of the longitudinal lower burner halves of the corresponding inshot burner which are embossed thereinto in a spaced array to match the location of the to be inter-joined embossed upper burner halves. The upper burner half shell is disposed upon the lower burner half shell with the respective plurality of longitudinal upper and lower halves of the inshot burners in registered alignment. This construction forms a plurality of spaced inshot burners.

The embossable metallic material may preferably comprise aluminized steel sheeting, although other materials are contemplated. Such aluminized steel sheeting may be 20 gauge material, although other gauges and other materials may be used.

The upper burner and lower burner half shell elements are preferably substantially mutual mirror images thereof, and in fact may be identically formed and on the same apparatus for disposing in back-to-back array for assembly. Such assembly may be joined by means of flanges on one shell extending through openings in the other shell and bent over to secure upper and lower burner half shells to one another. Alternatively, the upper and lower burner half shells may be welded together. Yet additionally, the embossed burner elements of the upper and lower inshot burner half shells may be separated by a plurality of inter-burner connection apertures, with one or the other of such inshot burner half shell elements including flanges disposed in a location corresponding to such openings. Accordingly, such flanges may be bent over and around such inter-burner connection apertures openings in order to secure the upper and lower inshot burner half shells together.

Such inshot burner halves include a gaseous fuel and air entry end and a flame exit end. A corresponding plurality of gaseous entry ports are provided for providing gaseous fuel to each of the gaseous fuel and air entry ends. The longitudinal half of each of the gaseous entry ports is embossed into both of the upper and lower half shells. Such gaseous fuel and air entry ends comprise a flared or bell shaped end for receiving the gaseous fuel from the gaseous entry ports, and also for receiving primary air from the atmosphere.

Each of the defined inshot burners includes a hollow body which is substantially in the shape of an elongated and truncated cone—i.e., in a frusto-conical shape. The base of the frusto-conical shape is disposed at the flame exit end of the hollow body, and the apex end of elongated truncated cone is disposed at the gaseous fuel and air entry end thereof. The flared end of the hollow burner body is connected to the apex end of the frusto-conical body.

A gas manifold having a plurality of gaseous conduits connected thereto for supplying the gaseous fuel to each of the inshot burners is provided. Bracket means are also necessarily provided for mounting the upper and the lower burner half shells in mutually operative disposition with respect to the induced draft combustion heat exchanger.

A plurality of longitudinally extending connection apertures are disposed in spaced array in each of the upper and lower burner half shells. When the burner half shells are disposed in registered alignment these connection apertures are disposed and in mutually congruent spaced array in each of the upper and lower burner half shells. One of the upper and lower burner half shells includes a corresponding disposed flange means for bending over at the corresponding connection aperture for mechanically securing the upper and lower burner half shells together. These connection apertures preferably alternate on the selected burner half shell with the longitudinally extending burner halves, although other arrangements are contemplated.

Each inshot burner further includes a corresponding primary air aperture, a plurality of which are registered with the corresponding inshot burner element on each of the upper and lower half shells. Such registered primary air apertures are disposed at the gaseous fuel and air entry end of the each of the inshot burners, to provide primary air to the gaseous fuel injected into the inshot burner body. Such registered primary air apertures are disposed between each of the gaseous fuel entry ports and the corresponding gaseous fuel and air entry end of the corresponding inshot burner, whereby the flow of the gaseous fuel into the inshot burner body remains unobstructed.

Referring now to the drawing and to FIG. 1 in particular, the improved inshot burner cluster apparatus of the present invention generally 10 includes an upper burner half shell 12. Upper burner half shell 12 includes a plurality of longitudinal upper burner halves 14 for each of the corresponding inshot burners 16 as shown in FIG. 2. Upper burner halves 14 are embossed into the metallic sheet material in spaced, and preferably evenly spaced array as shown in FIGS. 1 and 2. Upper burner half shell 12 is accompanied by a matching and an essentially identically shaped lower burner half shell 18. As with upper burner half shell 12, lower burner half shell 18 defines thereby a plurality of the longitudinal lower burner halves 20 of the corresponding inshot burner, as shown particularly in FIG. 2. As is also depicted in FIG. 2, upper burner half shell 12 is disposed upon lower burner half shell 20 in registered alignment. This construction forms the plurality of spaced inshot burners 16.

As shown in FIG. 1, assembly of upper burner and lower burner half shells 12,18 may be accomplished by means of welding together upper and lower burner half shells 12,18. Also, as shown in FIG. 1, upper and lower inshot burner half shells 12,18 may include a plurality of connection apertures 24, with one or the other of such inshot burner half shell 12,18 also including flanges 26 disposed in a location corresponding to such corresponding apertures 24. Accordingly, flanges 26 may be bent over and around the corresponding connection apertures 24 in order to secure upper and lower inshot burner half shells 12,18 together.

Inshot burner halves 12,18 include a gaseous fuel and air entry end 28 and a flame exit end 30. A corresponding plurality of gaseous entry ports 32 are provided for providing gaseous fuel to each of the gaseous fuel and air entry ends 28. As shown in FIG. 4, the longitudinal half of each of gaseous entry ports 32 is embossed into both of the upper and lower half shells 12,18. Such gaseous fuel and air entry ends 28 comprise a flared (or bell shaped) end 34 for receiving the gaseous fuel from gaseous entry ports 32, and also for receiving primary air from the atmosphere.

As shown in FIG. 4 in particular, each of the defined inshot burners 14 includes a hollow burner body 38 which is substantially in the shape of an elongated and truncated cone—i.e., in the frusto-conical shape. The base of the frusto-conical shape is disposed at the flame exit end 30 of hollow body 38, and the apex end of elongated truncated cone is disposed at the gaseous fuel and air entry end 28 thereof, and flared end 34 of hollow burner body 38 is connected to the apex end of the truncated cone.

A gas manifold (not shown) having a plurality of gaseous conduits connected thereto for supplying the gaseous fuel to each of inshot burners 14 is provided. Bracket means (also not shown) are also provided for mounting the upper and the lower burner half shells 12.18 in mutually operative disposition with respect to the induced draft combustion heat exchanger, and in a manner known to those skilled in the art.

Each inshot burner further includes a corresponding primary air aperture 36, a plurality of which are registered with the corresponding inshot burner 14 on each of the upper and lower half shells 12.18. Registered primary air apertures 36 are disposed at the gaseous fuel and air entry end 28 of the each of the inshot burners 14, to provide primary air to the gaseous fuel injected into the inshot burner body. Registered primary air apertures 36 are disposed between each of the gaseous entry ports 32 and the corresponding gaseous fuel and air entry end 28 of the corresponding inshot burner 14, whereby obstruction of the flow of the gaseous fuel into the inshot burner hollow body 38 remains unobstructed.

The basic and novel characteristics of the improved methods and apparatus of the present invention will be readily understood from the foregoing disclosure by those skilled in the art. It will become readily apparent that various changes and modifications may be made in the form, construction and arrangement of the improved apparatus of the present invention, and in the steps of the inventive methods hereof, which various respective inventions are as set forth hereinabove without departing from the spirit and scope of such inventions. Accordingly, the preferred and alternative embodiments of the present invention set forth hereinabove are not intended to limit such spirit and scope in any way.

What is claimed is:

1. An improved inshot burner cluster for use in association with an induced draft combustion heat exchanger, said inshot burner cluster comprising:

an upper burner half shell unitarily formed of a sheet of an embossable metallic material, said upper burner half shell having a plurality of longitudinal upper burner halves of corresponding inshot burners embossed thereunto in spaced array thereon;

a lower burner half shell unitarily formed of a sheet of an embossable metallic material, said lower burner half shell having a plurality of longitudinal lower burner halves of corresponding inshot burner embossed thereinto in spaced array thereon; and and means for securing said upper burner half shell to said lower burner half shell with said respective longitudinal upper and lower halves of said plurality of inshot burners in registered alignment to form thereby a plurality of spaced inshot burners.

2. The improved inshot burner cluster of claim 1 wherein said inshot burners are disposed in equally spaced array.

3. The improved inshot burner cluster of claim 1 wherein said embossable metallic material comprises aluminized steel.

4. The improved inshot burner cluster of claim 3 wherein said embossable metallic material comprises 20 gauge aluminized steel.

5. The improved inshot burner cluster of claim 1 wherein upper burner and said lower burner comprise substantially mutual mirror images.

6. The improved inshot burner cluster of claim 1 wherein each of said burner halves has a gaseous fuel and air entry end and a flame exit end.

7. The improved inshot burner cluster of claim 6 further comprising a corresponding plurality of gaseous entry ports for providing gaseous fuel to each said gaseous fuel and air entry end.

8. The improved inshot burner cluster of claim 7 wherein said gaseous fuel and air entry ends comprise flared end means for receiving the gaseous fuel from said gaseous entry ports.

9. The improved inshot burner cluster of claim 7 further comprising a plurality of registered primary air apertures in said upper and said lower half shell disposed at said gaseous fuel and air entry end thereof.

10. The improved inshot burner cluster of claim 9 wherein said registered primary air apertures are disposed between each of said gaseous fuel entry ports and said corresponding gaseous fuel and air entry end of said inshot burner, whereby flow of gaseous fuel thereinto remains unobstructed.

11. The improved inshot burner cluster of claim 8 wherein each of said inshot burners comprises a hollow body which is substantially the shape of an elongated and truncated cone.

12. The improved inshot burner cluster of claim 11 wherein the base of said elongated truncated cone is disposed at the flame exit end thereof, and the apex end of said elongated truncated cone is disposed at the gaseous fuel and air entry end thereof.

13. The improved inshot burner cluster of claim 12 wherein said flared end is connected to said apex end of said truncated cone.

14. The improved inshot burner cluster of claim 1 wherein a longitudinal half of each of said gaseous entry ports is embossed into said upper and lower half shells.

15. The improved inshot burner cluster of claim 1 further comprising a gas manifold having a plurality of gaseous conduit means connected thereto for supplying gaseous fuel to each of said inshot burners.

16. The improved inshot burner cluster of claim 1 further comprising bracket means for mounting said upper and lower burner half shells in operative disposition with respect to said induced draft combustion heat exchanger.

17. The improved inshot burner cluster of claim 1 further comprising a plurality of longitudinally extending connection apertures disposed in spaced array in one of said upper and lower burner half shells, and said other of said upper and lower burner half shells including a correspondingly disposed plurality of flange means for engagement at the corresponding said connection apertures and for mechanically securing said upper and lower burner half shells together.

18. The improved inshot burner cluster of claim 17 wherein said longitudinally extending connection apertures alternate on said burner half shells with said longitudinally extending burner halves.

* * * * *